US005390916A

United States Patent [19]

Govoni

[11] Patent Number: 5,390,916

[45] Date of Patent: Feb. 21, 1995

[54] COMBINATION GOLF PUTTER CONTAINER AND CLUB HOLDER

[75] Inventor: David A. Govoni, Daytona Beach, Fla.

[73] Assignee: Par 3 Enterprises Corporation, Jacksonville, Fla.

[21] Appl. No.: 105,145

[22] Filed: Aug. 12, 1993

[51] Int. Cl.[6] ..... A63B 55/04; A63B 55/10; A63B 57/00

[52] U.S. Cl. ..... 273/32 B; 248/156; 248/530

[58] Field of Search ..... 206/315.2, 315.3, 315.6; 248/156, 530; 211/70.2; 273/32 B, 32 E

[56] References Cited

U.S. PATENT DOCUMENTS

| | | | |
|---|---|---|---|
| D. 318,090 | 7/1991 | Bahns | D21/223 |
| 2,595,987 | 5/1952 | Shears | 150/1.5 |
| 2,970,629 | 2/1961 | Masten | 150/1.5 |
| 3,554,255 | 1/1971 | Mangan | 150/1.5 |
| 5,102,529 | 4/1992 | Hickin | 206/315.6 X |

*Primary Examiner*—George J. Marlo
*Attorney, Agent, or Firm*—Edward M. Livingston

[57] ABSTRACT

A combination container and holder (1) for a golf putter (5) and other clubs having a tube (19) with an open top (3) and closed bottom (12), a spike (2) for inserting the holder (1) into the ground (20) during play and a hook (4) extending from the tube (19) for retaining a wedge club (6) leaned against it during play. This holder helps to eliminate getting clubs and grips wet and dirty and bending to pick up clubs during play. It also protects and preserves golf club putters when out of the bag during play and even in the bag during storage and transportation. Optional holes (13) are provided in the tube bottom (16) to allow rain, moisture and dirt to drain from the tube (19). Optional supports may be added to the bottom floor (12) of the tube (19) to hold the putter above the floor of the tube (19) and keep it from touching any moisture or dirt on the bottom thereof.

5 Claims, 1 Drawing Sheet

COMBINATION GOLF PUTTER CONTAINER AND CLUB HOLDER

BACKGROUND OF THE INVENTION

This invention relates to golf club holders and more particularly to a combination container for holding a putter when both inside and outside a golf club bag and also for retaining another club outright during play.

Normally, when a golfer is near a green on a golf course, to avoid having to return to the golf bag or cart which may be some distance away, the golfer takes and carries both a wedge club and putter club to where the golf ball is located. While using the wedge club to hit the ball onto the green, the putter must be placed on the ground. If the ground is wet, which is common early in the morning, the putter club and its grip often gets wet and dirty. Then, after hitting the ball with the wedge club onto the green, the golfer must then place the wedge club on the ground while using the putter to hit the ball into the hole. Thus, the wedge also gets wet and dirty. Getting the putter and wedge clubs wet and dirty on a regular basis can lead to rust and corrosion which adversely affects the appearance and decreases the life of the club. Even worse, the wedge club is often forgotten and lost.

In addition to the above problems associated with using the wedge and putter clubs, many people, especially those with arthritis and the elderly, have difficulty bending over to pick up such when playing golf. Thus, there exists a need for a device that will eliminate bending and the above problems.

The prior art contains some devices that have attempted to resolve this problem, but none is like the present invention. For instance, U.S. Pat. No. 318,090 by Bahns, issued Jul. 9, 1991, teaches a golf club holder against which clubs can be leaned. However, Bahns does not have a tube-like container to hold and protect the golf putter while it is both in and out the golf bag. U.S. Pat. No. 2,970,629 by Masten, issued Feb. 7, 1961, teaches an entire carrying case with multiple tubes having a spike on the bottom. However, Masten is not designed, nor is it usable in the same fashion as the present invention and contains no hook against which another club can be leaned during play. U.S. Pat. No. 2,595,987 by Shears, issued May 6, 1952, discloses a tube for holding a club and has a clip to attach it to a bag. However, Shears contains no spike for sticking it into the ground nor any hook for holding a club. U.S. Pat. No. 3,554,255 by Mangan, issued Jan. 12, 1971, discloses an adapting collar for a golf bag with holding hollow tubes into which golf clubs are inserted. However, the tubes contain no spikes so it cannot be placed upright into the ground during use. Further, in Mangan the tubes contain no hook against which to lean other clubs during play.

Contrary to the prior art, the present invention provides a combination container for a golf putter which can hold a golf putter while it is either inside and outside the golf bag during play, which contains a spike on the bottom for holding it upright when outside the bag and a hook on the top of the tube against which a wedge or other club can be leaned during use. Also, the present invention contains optional holes in the bottom of the tube to allow for the drainage of water and moisture which might get into the tube during rain. Even furthermore, the present invention may contain supports at the bottom of the tube for holding the clubs away from the bottom to prevent moisture and dirt from getting on the grips of the putter.

SUMMARY OF THE INVENTION

The primary object of the present invention is to provide a device that holds and protects golf clubs, especially the putter, from damage both while in and out of the golf club carrying bag.

Another object of the present invention is to provide a device which helps prevent the inadvertent loss of golf clubs, particularly wedge clubs, during golf play.

A further object of the present invention is to provide a device which prevents a putter or wedge club from becoming wet and dirty as a result of laying such clubs on the ground during play.

A related object of the present invention is to provide a device which prevents the grips on a putter and wedge clubs from becoming wet during play.

An even further object of the present invention is to provide such a device that eliminates bending to pick up a putter or wedge club during play.

The present invention fulfills the above and other objects by providing a holder for a putter and other golf clubs which has an elongated tube having an open top and closed bottom to which a spike is attached for holding the tube upright when inserting it into the ground and with a hook extending from near the top of the tube in order to retain another golf club resting against the holder. The tube bottom may have holes to allow drainage of moisture and dirt that may get into the tube. The floor of the tube may also have supports for holding the golf club away from the bottom. Even furthermore, the holder may contain a collar attached around the top of the tube from which the hook extends to provide a better grip for the golfer and more support for the hook.

The above and other objects and advantages of this invention may become more readily apparent when a preferred embodiment is described in conjunction with accompanying drawings.

BRIEF DESCRIPTION OF THE DRAWINGS

The drawings used to illustrate a preferred embodiment of the invention are as follows.

DESCRIPTION OF THE PREFERRED EMBODIMENTS

Figure 1:
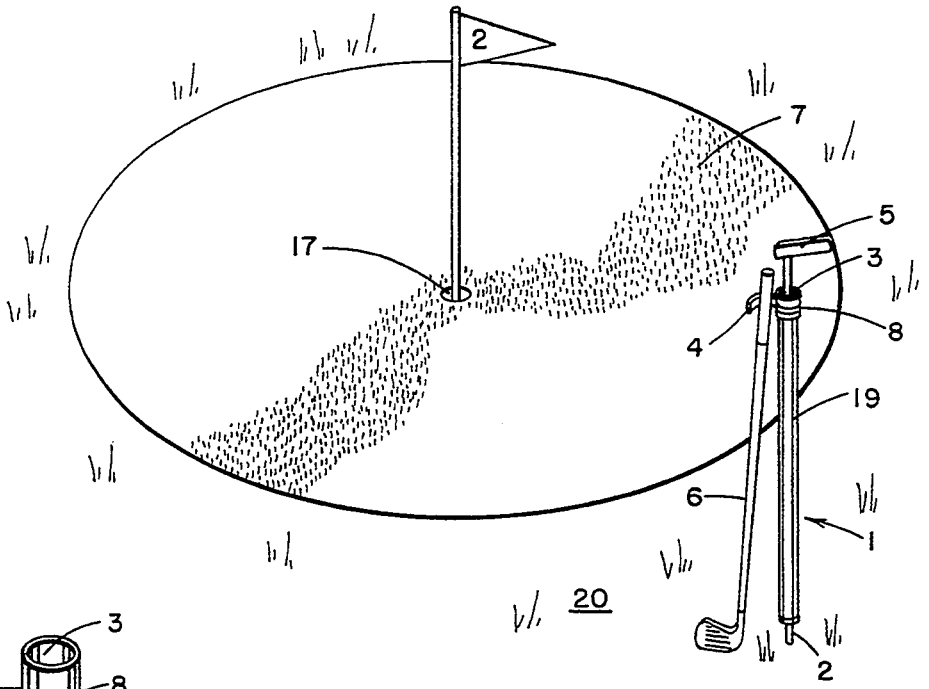
FIG. 1 is a perspective view of the golf club holder on the edge of the green holding a putter club and retaining a wedge club leaning against the hook on the top thereof.

Referring to the drawings, in FIG. 1 the invention consisting of a combination putter container and golf club holder 1 is shown being held in an upright position with a spike 2 being inserted into the ground 20. The tube portion 19 of the invention 1 has an open top 3 into which the putter club 5 is inserted and contained. Near the top of the tube 19 is a hook 4 which may extend horizontally from the top of the tube portion 19 or from a collar 8 on the top of the tube. The use of a collar 8 may provide more strength and support for the hook 4 and also make it easier for a golfer to grip the invention. As depicted in FIG. 1, the invention 1 is best used near a green 7 when hitting a golf ball onto the green 7 and putting it into the hole 17.

Figure 2:
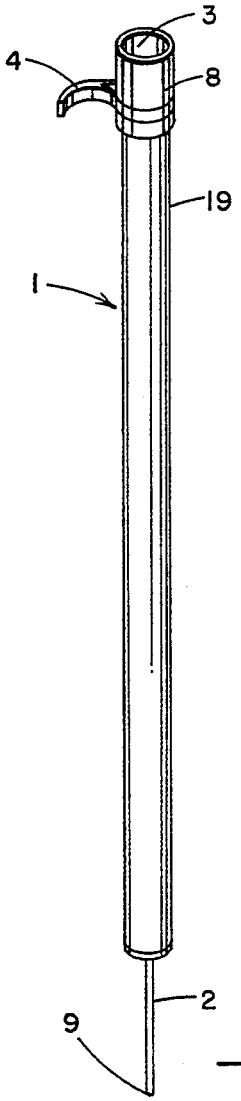
FIG. 2 is a perspective view of the combination golf club container and holder by itself.

In FIG. 2 the combination container and holder 1 is shown by itself which shows more clearly the tube portion 19, the open top 3, the spike 2 and the hook extending from the collar 8 on the top of the tube portion 19. The bottom of the spike 2 may contain a slightly rounded point 9 for easy insertion into almost any type of ground on a golf course.

Figure 3:
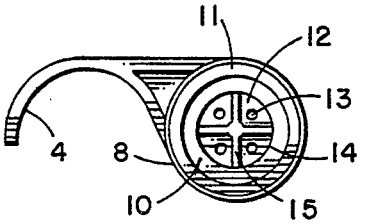
FIG. 3 is a top view of the combination container and holder.

In FIG. 3 a view through the top opening 3 of the invention shows the top 11 of the collar 8 with the hook 4 extending therefrom. The inner wall 10 of the tube 19 extends from the collar 8 to a bottom floor 12 which has an outer diameter 14 having the same dimension as the top of the tube 19. The bottom floor 12 may contain one or more holes to allow any moisture and dirt to drain from the tube 19. An optional feature in FIG. 3 is cross-supports 15 to hold a grip of the putter 5 above the bottom floor 12 of the tube 19 to keep moisture and dirt from touching the grip of the putter 5 when it is contained therein.

Figure 4:
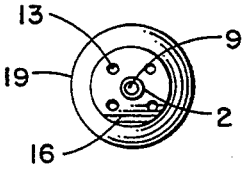
FIG. 4 is a bottom view of the container/holder showing holes on the bottom and the spike extending therefrom.

In FIG. 4 the bottom surface 16 of the tube 19 is illustrated showing the spike 2 with point 9 extending from the center thereof and the drainage holes 13 through the bottom of the tube.

Figure 5:
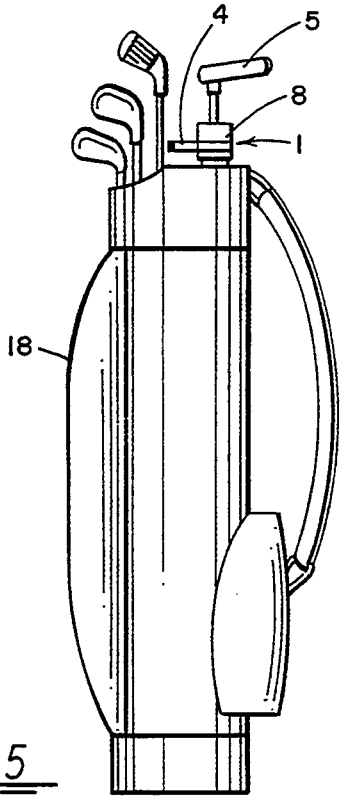
FIG. 5 is a side view of the combination container and holder when it is in the golf bag with the golf club putter therein.

The final FIG. 5 shows the golf club holder 1 when it is contained in a golf club bag 18. The golf club holder 1 is shown with the club putter 5 contained therein with its collar 8 and hook 4 extending therefrom. While the holder 1 is in the golf bag 18 it protects the club putter 5 from damaging the shaft or grip of the putter during storage or transportation.

The combination golf putter container and club holder 1 is preferably made primarily from plastic, particularly for the tube portion 19 and collar 1, with the spike 2 being made of metal so it could withstand the pressure of being forced into the ground during use.

Although only a preferred embodiment of the present invention has been described above, all variations and modifications within the scope or equivalent of the claims are covered by this invention.

I claim:

1. A combination container and holder consisting essentially of:

a single elongated tube sized to accomodate the shaft of a single golf club and having an open top and closed bottom;

a spike attached to the bottom of the tube for holding the tube upright when the spike is inserted into the ground; and a generally semicircular hook extending from near the top of the tube to retain another golf club resting against the tube.

2. The combination container and holder of claim 1 wherein the tube contains one or more holes in the bottom thereof to allow drainage of moisture and dirt which may get into the tube.

3. The combination container and holder of claim 2 wherein the bottom of the tube on the upper surface thereof contains at least one support extending above the upper surface for holding a golf club above the bottom.

4. The combination container and holder of claim 1 wherein the bottom of the tube on the upper surface thereof contains at least one support extending above the upper surface for holding a golf club above the bottom.

5. The combination container and holder of claim 1, 2, 3 or 4 wherein the hook extends from a collar attached around the top of the tube.

* * * * *